US006119892A

United States Patent [19]

Laurent et al.

[11] Patent Number: 6,119,892

[45] Date of Patent: Sep. 19, 2000

[54] MODULAR POCKET MEDICATION DISPENSER

[75] Inventors: Hervé Laurent, Paris; Valérie Oriol, Miribel, both of France

[73] Assignee: Biostat S.A., Levallois-Perret, France

[21] Appl. No.: 09/041,448

[22] Filed: Mar. 12, 1998

[51] Int. Cl.[7] ..... G07F 11/00

[52] U.S. Cl. ..... 221/2; 221/131

[58] Field of Search ..... 221/2, 3, 7, 9, 221/15, 92, 129, 124, 131, 206

[56] References Cited

U.S. PATENT DOCUMENTS

| | | | |
|---|---|---|---|
| 4,695,954 | 9/1987 | Rose et al. | 364/413 |
| 5,099,463 | 3/1992 | Lloyd et al. | 368/10 |
| 5,148,944 | 9/1992 | Kaufman et al. | 221/131 |
| 5,200,891 | 4/1993 | Kehr et al. | 364/413.01 |

FOREIGN PATENT DOCUMENTS

| | | | |
|---|---|---|---|
| 0429660 A1 | 5/1990 | European Pat. Off. | A61J 3/00 |
| 2099803 | 6/1981 | United Kingdom | G04C 23/00 |
| WO 9404966 | 8/1993 | WIPO | G04B 47/00 |

*Primary Examiner*—Kenneth W. Noland

*Attorney, Agent, or Firm*—Lowe, Hauptman, Gopstein, Gilman & Berner, LLP

[57] ABSTRACT

A modulart medication-dispenser (1) adapted to be held in a pocket and being composed of a main module (2) itself comprising two compartments (2*a*, 2*b*) containing electronics sufficient for memory, calculation and data-retrieval relating to medication-dispensing by a compartment. The main module (2) also comprises visual data displays (3) and alarms (6). The dispenser is characterized in that at least one detachable additional compartment (5), comprising locking means (501, 502) and fasteners (503, 504) and forming a storage space for a given type of tablets, is detachably attached to the main module (2). The locking means (501) and the fasteners (503) of the preceding compartment cooperate with respectively the fasteners (504) and locking means (502) of the next additional compartment. Each compartment comprises a drive means (516) for a unit-dispensing component (515; FIG. 2*b*) adaptable to different sizes of pharmaceutical medications.

19 Claims, 6 Drawing Sheets

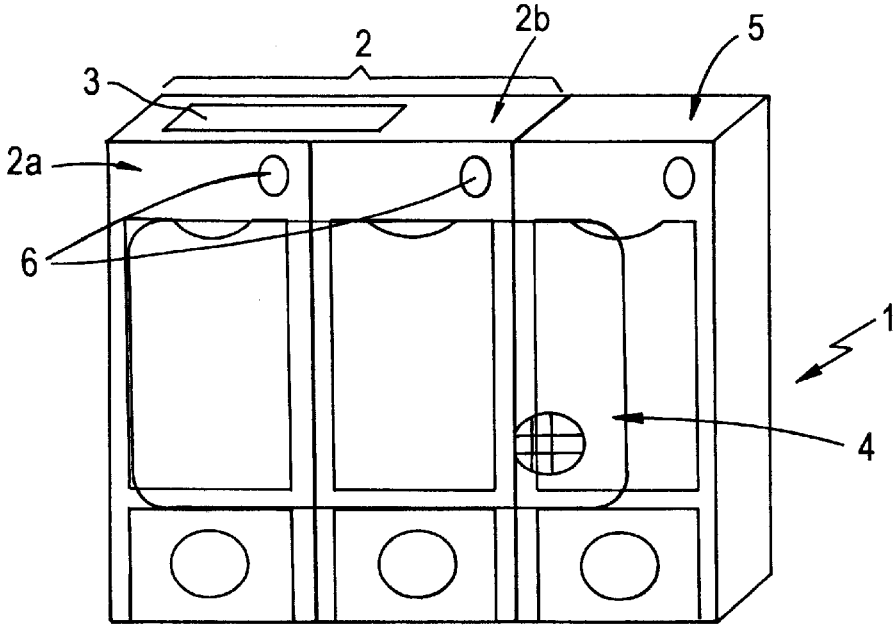
FIG. 1
FIG. 5a
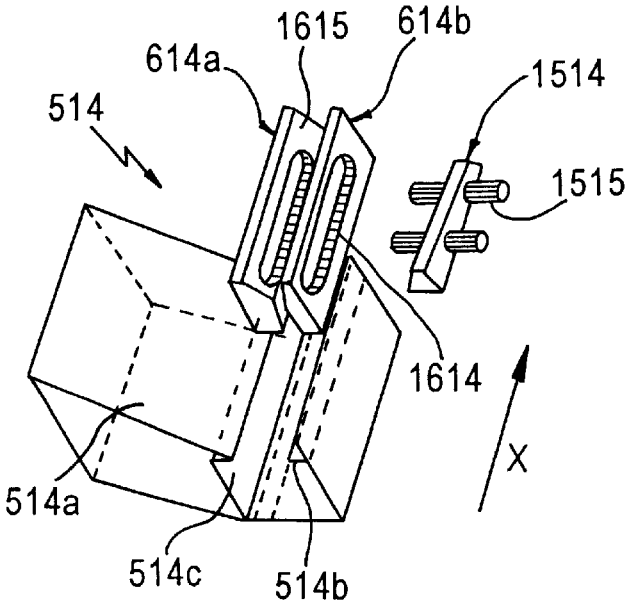
FIG. 5b
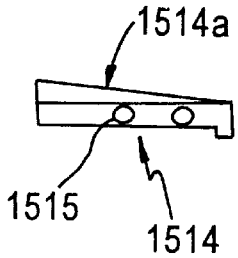

FIG. 2a
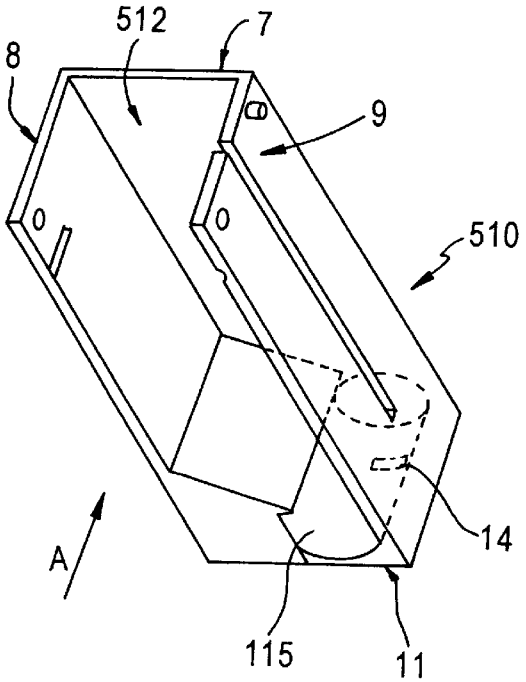
FIG. 2b
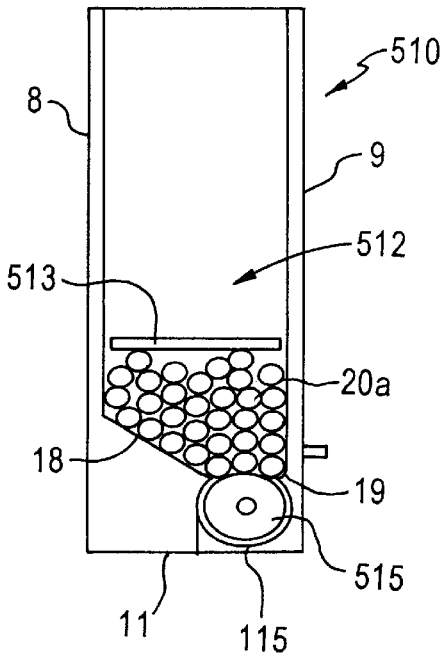
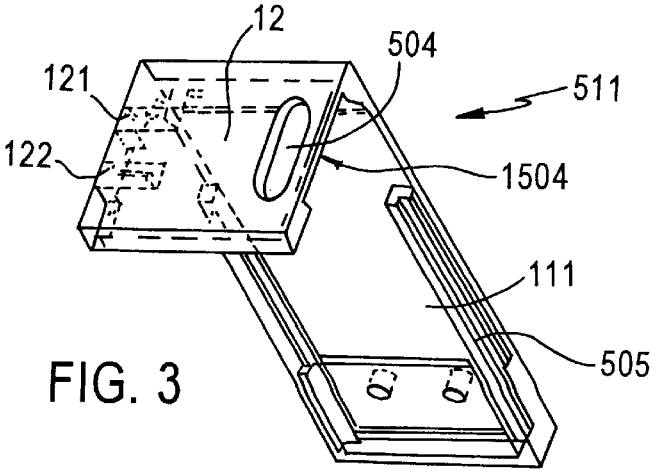
FIG. 3

MODULAR POCKET MEDICATION DISPENSER

The present invention concerns a modular pocket dispenser of medications such as capsules and tablets of different sizes.

BACKGROUND OF THE INVENTION

Published European patent application 0,554,137 A1 discloses a pocket dispenser for medications in the form of capsules or tablets and comprising a dispensing case and a detachable loader, said loader comprising several transverse compartments able to store medications and forming a continuous longitudinal chain. This dispenser comprises optical means mounted near the outlet orifice and that detect the transit of the medication exiting from the compartments.

Such a dispenser has a drawback in that the medications must be arranged in the sequence of their ingestion and, when there are different times for ingestion of different medications, the configuration of the compartments becomes complex. The design solution of using one dispenser for each type of medication then becomes both costly and bulky. Moreover the optical detectors are susceptible to being soiled and may detect poorly when medications of different colors and different sizes are used.

Published French patent application 2,650,426 furthermore discloses a non-portable programmable dispenser that receives medications for housing in sorted drawers. The dispenser displays the dosages of the medications to be ingested. The patient pushes a button to open the drawers.

The drawback of such a dispenser is that the patient must consult a screen to learn the number and quantity of medications to take. Since the stores of medications are accessible, the patient himself must ensure their accurate dispensing. The danger inherent in self-treatment, in particular of dangerous drugs, is that it is possible to exceed the prescribed dosages. Moreover such a dispenser does not automatically detect the removal of medication which is merely confirmed by the user.

OBJECTS AND BRIEF DESCRIPTION OF THE INVENTION

One objective of the present invention is to ameliorate the drawbacks of the prior art by means of a tablet dispenser which that allows automatic issuance of a plurality of different medications.

These objectives are attained by the modular pocket medication dispenser of the invention which comprises a main module containing the electronic memory means, a calculating means and a data retrieval means detailing the dispensing of medications from each compartment. The main module 2 comprises data displays and alarms. The dispenser is characterized in that at least one additional and detachable compartment comprising locking means and fasteners, and forming a storage space for one type of tablets, is detachably joined to the main module. The locking means and fasteners of the preceding compartment cooperate, respectively, with the locking means and fasteners of the additional compartment. Each compartment comprises a drive means for a unit-dispensing system which can adapt to different sizes of pharmaceutical medications.

In another feature of the invention, the first additional compartment is joined to the main module, whereas the following compartments are joined laterally and the (n+1) the additional compartment is detachably joined to the $n^{th}$ additional compartment.

In another feature of the invention, each compartment comprises electronic means operatively connected to the electronic means of the preceding compartment.

In another feature of the invention, each detachable compartment comprises a substantially parallelipipedic case which is open at two adjacent sides. A complementary hood and a detachable sealing flap are associated with the case and are adapted to close the compartment. Each compartment constitutes a store for medications and is fitted with means that bias the medications in the direction of the lower end, which forms the store's base. The store base contains a cylindrical well that issues through an outlet orifice in a lower side of the compartment. The dispensing system comprises a cylindrical pinion-in the cylinder well that can be rotatably driven in the well about its axis by a drive means.

In another feature of the invention, the adaptable dispensing system comprises a groove in the cylindrical enclosure, with the groove being fitted with means for keeping removable gauges, of shapes complementary to the groove and inserted therein, in place. Each gauge is designed to have a cavity adapted to receive the required tablet size, while allowing the received tablet to slightly project from the pinion-enclosure cylinder.

In another feature of the invention, the drive means comprises an actuating button located in a housing near the dispensing systems in the compartment case. When the button is in its rest position, one side of the button issues through a side of the compartment. The actuating button is displaceable toward the inside of the compartment and is adapted to translate at least one gear rack guided inside a well at the end of the button housing in the compartment case. Each gear rack cooperates with a pinion mounted at the end of the enclosure thereby forcing its rotation. A return spring moves the button back into its rest position when it is no longer actuated (being pressed).

In another feature of the invention, the dispenser comprises at least one compartment, comprises selection means, mounted at the base of the storage space and upstream of the adaptable dispensing systems.

In another feature of the invention, the selection means comprise two V-sloping surfaces that are adapted to guide tablets toward a central selector groove. A selector slider, that is displaceable between two strips, is located in a central selector groove. The slider guides the tablet toward a passage of a size that is adapted to the tablet size.

In another feature of the invention, the gauges being used, and the adjustments of the selector sliders, are selected from a nomogram defining the gauge types and the positions of the selector sliders to be used for the various medications.

In another feature of the invention, the removable locking means respectively comprise a substantially U-shaped strip. The legs of the U are affixed to the upper end of a side of a compartment, where that compartment side is adapted to contact a side of an adjacent compartment. The base of the U is thicker than the ends of its legs. At least one claw is located near the common lower side edge, near the opposite side, and parallel to the strip-bearing side. The complementary fasteners respectively comprise holes fitted with affixing rods and are located on the common edge at the lower side and at the contact side that bear the strip on the edge that is opposite to the edge that is fitted with claws. The fasteners also comprise an aperture in the upper compartment side near the crest with the contact side bearing the claws. The claws of the additional compartment are adapted to engage the affixation rods in the holes of the preceding compartment. The elliptical base of the strip of the preceding compartment is adapted to hook into the aperture of the additional compartment by entering through an orifice that is perpendicular to the aperture is situated at the upper end of the claw-bearing side.

In another feature of the invention, the means biasing the medications toward the exit of the storage space comprises a pallet formed by a plate affixed to a slider disposed for sliding in a vertical channel located in the compartment's back side (a side that is not attached to an adjacent storage space). Elastic means bias the plate toward the dispensing systems located at the base of the compartment's storage space base.

In another feature of the invention, at least one compartment, and preferably all compartments, comprises detectors that are adapted to sense tablet transit.

In another feature of the invention, the detectors of tablet transit comprise a mechanical micro-switch that is situated near a peripheral enclosure surface. The micro-switch is suitably driven by a portion of the tablet projecting outside the enclosure during the time that the tablet is being rotated.

In another feature of the invention, the compartments comprise detectors adapted to sense the pressure on the drive means.

In another feature of the invention, thee detectors of pressure on the drive means consist of a microswitch actuated by a stud affixed to the button.

In another feature of the invention, the main module comprises three compartments, a main compartment, comprising two compartments, and a additional compartment affixed to the main compartment. The additional compartment comprises a slot on the side thereof that is between two adjacent compartments. The slot is adapted to accept a data medium, such as a chip card, which is adapted to be inserted straddling the first three compartments constituted by the main module and the first additional compartment.

In another feature of the invention, the displays consist of a liquid crystal screen.

In another feature of the invention, the alarms are an LED (light emitting diode) and/or an acoustic means.

Another object of the present invention is to provide a modular tablet-dispenser comprising detachable, universal, multivalued compartments adapted to house various sizes of tablets or other objects to be dispensed.

This objective is attained by the dispenser of this invention by providing a hatch in each compartment that enables access to the enclosure whereby permitting replacement of gauges. This hatch is suitably closed by a enclosure-hiding cover affixed to the container by studs.

Other features and advantages of the present invention will become apparent from the following description and in relation to the attached drawings and claims.

BRIEF DESCRIPTION OF THE DRAWING

FIG. 1 is a perspective view of a medication dispenser of the invention comprising an additional, detachable compartment affixed to a main module, FIG. 2*a* is a perspective view of a case adapted to define a compartment of the invention, FIG. 2*b* is a side view in the direction A of FIG. 2*a* of a case defining a compartment according to the invention, and which shows capsules and holding means, FIG. 3 is a perspective view of a complementary hood that together with the case shown in FIG. 2 form a compartment of the invention, FIG. 5*a* is an exploded perspective of a selection means for use in the invention, FIG. 5*b* is a side view of the selector slider of FIG. 5*a,*

DETAILED DESCRIPTION OF THE INVENTION

Figure 4A:
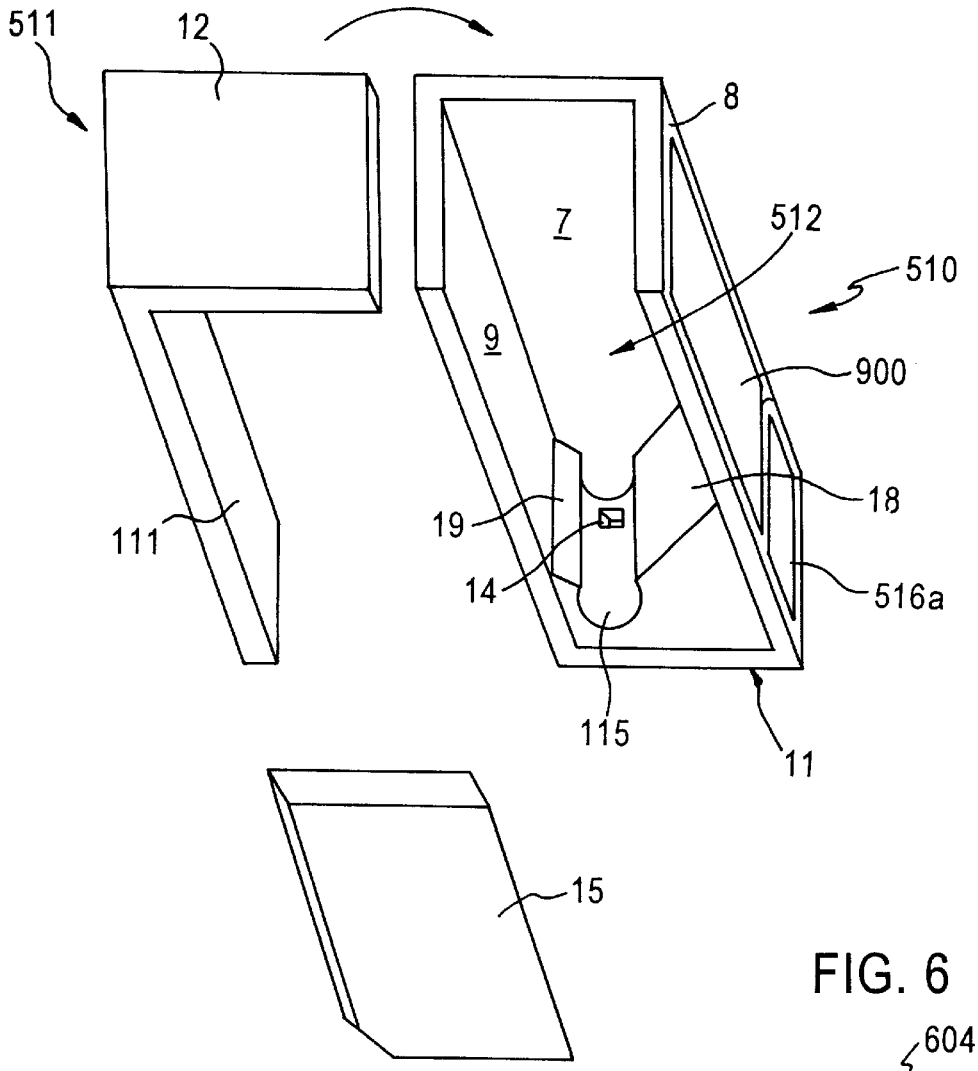
FIG. 4*a* is an exploded schematic view of the structure of a compartment of the invention.
Figure 6:
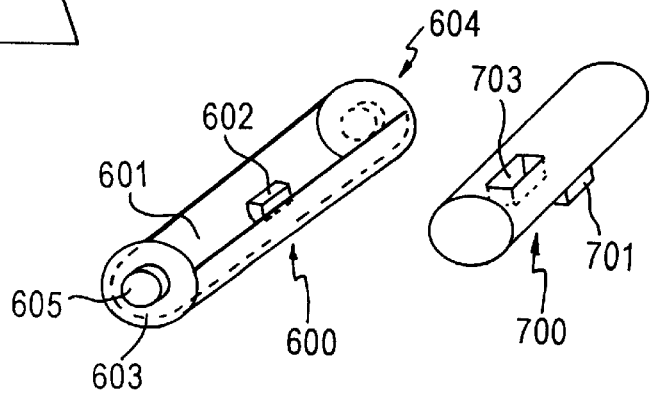
FIG. 6 is an exploded perspective view of the dispensing systems constituted by a subassembly of a pinion enclosure and a gauge (shown separated)

FIG. 1 is a perspective view of a medication dispenser 1, i.e., a pill box, of the invention including: a main module 2 to which is affixed at least one additional compartment 5. This main module 2 contains (not shown) electronics for memory, calculation, and data retrieval relating to dispensing medications. This main module 2 also contains a data display 3. The data display 3 as illustrated is, for example, in the form of a liquid-crystal screen. The main module 2 may be replaced by two compartments 2*a,* 2*b*. Furthermore each compartment 2*a,* 2*b* or 5 (a plurality of compartments 5 are contemplated as well) comprises alarms 6. The alarms 6 are preferably in the form of a blinking LED to signal that certain pills, i.e. the medication be taken, are in a particular compartment 5. The alarms also may be acoustic in a manner known per se. A detachable external data medium 4, mounted in the dispenser medium, is shown as if the pill box 1 were transparent. Illustratively of the data media 4 is a chip card suitably about the size of an ordinary credit card. A detachable additional compartment 5 containing one type of pills, or tablets, or other objects to be dispensed is joined to the main module 2.

FIGS. 2*a* & 4*a* are, respectively, a perspective view and an exploded perspective view of a case 510 constituting one of the compartments 5 of the invention. This case 510 is preferably a parallelepiped that is open at two adjacent sides. The three closed lateral sides of the case 510 are, respectively, the lateral contact side 7, the front face 8, and the lateral back face 9. These form a U-shaped chute. These lateral faces and side define a storage space 512. At one of its ends, forming the base, case 510 comprises a lower face 11 fitted with a medication discharge orifice 14. The compartment 5 may be designed to contain tablets or capsules or other shaped objects to be dispensed.

FIG. 2*b* is a side view, in the direction A of FIG. 2*a,* of the case 510 of the compartment 5 of the invention. Inclined surfaces 18 and 19 at the base of the storage space form a truncated V-shaped constriction directed toward the lower face 11 of the storage space 512. Capsules or tablets 20*a* are suitably biased toward the storage-space base by an overhead pallet 513. In this manner the chute shape of the surfaces 18 and 19 cooperates with the pallet 513 to facilitate moving the capsules into a cylindrical well 115 that houses the dispensing system 515.

FIG. 3 is a perspective view of a hood 511 that is adapted to be associated with a case 510 to complete the enclosure of the compartment 5. This hood 511 comprises two adjacent sides 111 and 12 that together form an L. The shorter of the two sides, namely 12, constitutes the upper end of the compartment 5.

FIG. 4*a* is a schematic exploded view of the structure of a compartment 5 of the invention. Each compartment 5 is composed of the assembly of the case 510, the hood 511, and a substantially rectangular, detachable sealing cover 15. The shorter hood side 12 covers the upper part of the case 510 and thus forms the upper end of the compartment 5. This upper end of the compartment hereafter shall be denoted by the reference 12. The other hood side 11 is joined to the back lateral side 9 of the case 510 to form a single side hereafter denoted as the "lateral back side 9". Lastly the cover 15 seals the remaining side opening of the case, thereby forming a lateral contact side 10 that is disposed between two adjacent compartments 5. This detachable cover 15 allows accessing of the storage space, in particular to load it with medication or other dispensed objects. This assembly may be carried out using snap-in means, for instance studs cooperating with complementary holes that are per se conventional. The inclined surfaces 18 and 19, that form a V-constriction, issue at the bottom of the case into a cylindrical well 115. At the front lateral side 8, which is preferably parallel to the back lateral side 9, the case furthermore comprises a label seat 900 in the form of a space adapted to receive a label bearing information on the medication present in that particular storage space 512. A drive button 516*a* is shown disposed on the lateral side 8 near the lower end 11 of the compartment 5.

Figure 4B:
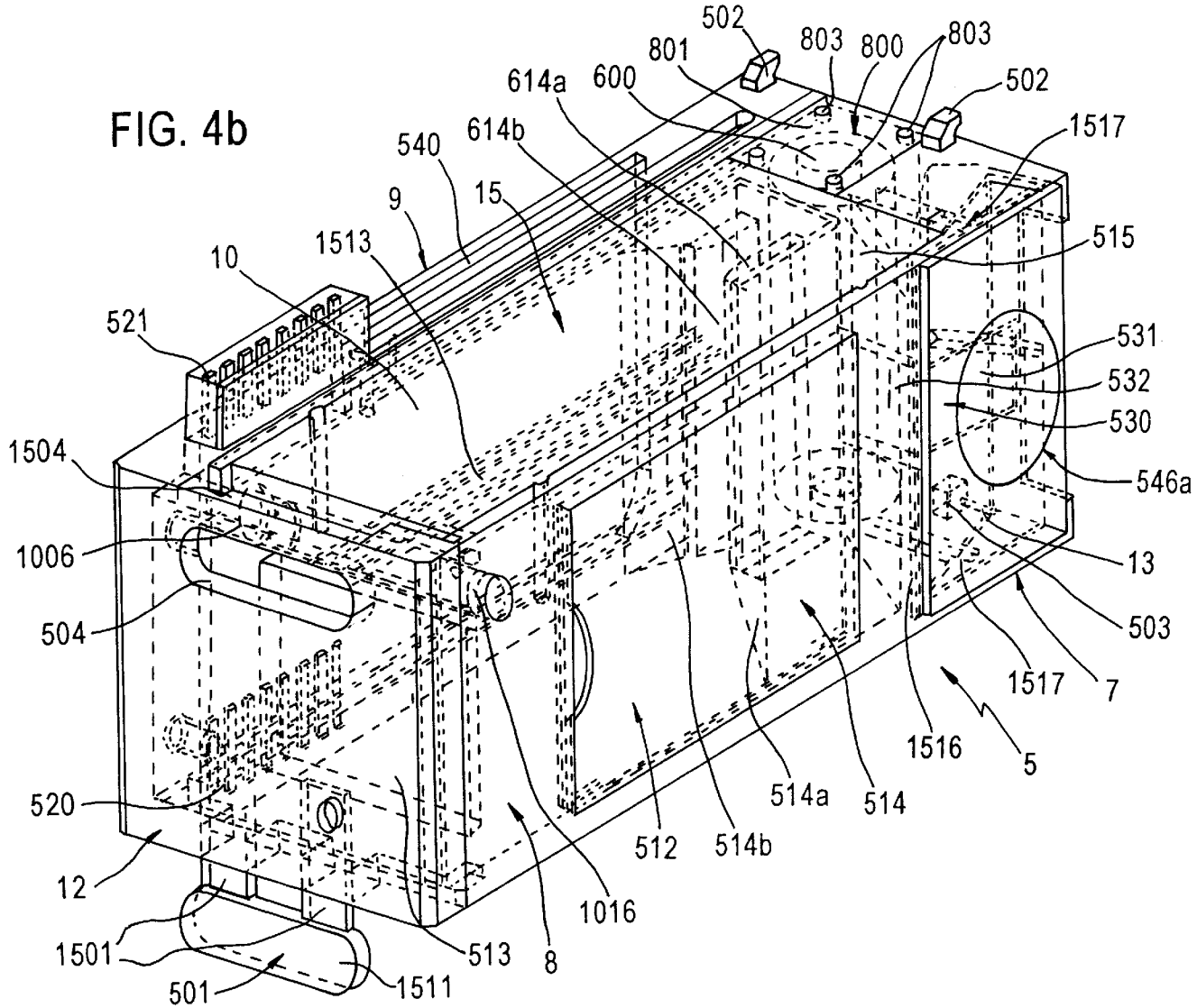
FIG. 4*b* is a perspective view of a compartment of the dispenser of the invention with dashed lines showing interior sub-structures.

A compartment 5 of the tablet pillbox of the invention will now be described in relation to FIGS. 4*b*, 4*c*, 6, 7 and 8. FIG. 4*b* is a perspective view of a detachable,, tablet-receiving compartment 5 of the pillbox of the invention which contains a selector 514. All the tablet-receiving compartments are substantially identical to each other, except that the selector 514 in some cases may not be in the V-constriction zone of the storage space 512 as shown in FIG. 2*b*. The compartment 5 bounds a storage space 512 at the bottom of which is a selector 514 (FIGS. 5*a*, 5*b*) resting above the inclined surfaces 18 and 19.

Figure 4C:
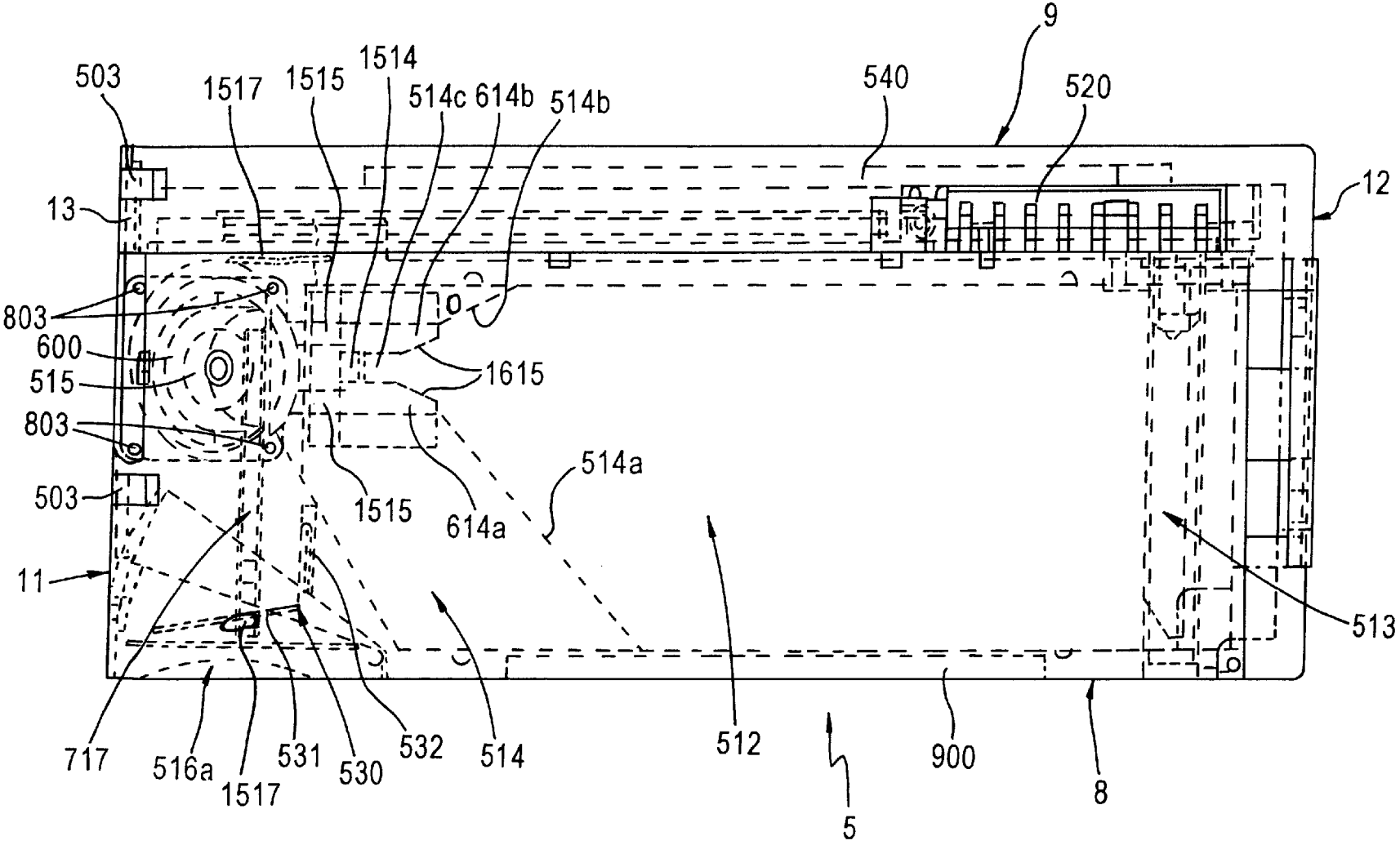
FIG. 4*c* is bottom view of the compartment of FIG. 4*b* invention with dashed lines showing interior sub-structures.

The selector 514 comprises two V-configured surfaces 514*a* and 514*b* that are adapted to guide the tablets toward a central trough 514*c* of the selector, which may be a parallelepiped (FIG. 4*c*). Two thin strips 614*a* and 614*b*, that are preferably substantially rectangular, are suitably mounted vertically in the trough 514*c*. Over part of their length and at their base, near the bottom of the groove, the strips 614*a* and 614*b* are fitted with catches 1614. The catches 1614 cooperate with lateral cylindrical feet 1515 present on both sides on the flanks of a selector slider 1514 situated between the strips 614*a* and 614*b*.

The upper and opposite edges of these strips are each beveled 1615 (FIG. 4*c*). These bevels 1615 subtend and create a funnel-shaped passage proximate to and directed toward the end of the storage space 512 between said strips 614*a* and 614*b* thereby assisting the easy intake of tablets. A slider 1514, that is preferably a parallelepiped, is transitionally displaceable, between the strips 614*a* and 614*b* in the trough 514*c*, in a direction that is preferably substantially parallel to the crest that is common to the adjacent lateral back side 9 and the lower end 11 of the compartment 5.

The upper side 1514*a* of the selector slider 1514 slopes down in the direction X (FIG. 5*b*) that is substantially parallel to the direction of translation of the slider 1514. The side 1514*a* is adapted to guide a tablet toward a passage bounded by the front of the selector slider 1514, by the inner sides of the two strips 614*a* and 614*b*, and by the lateral case contact side 7. The size of the passage can be adjusted by changing the position of the selector slider 1514 between the strips 614*a* and 614*b*.

A dispensing system 515, composed of a cylindrical pinion-enclosure 600 (FIG. 6), is mounted at the output of the selector 514, that is in a downstream position past the selector 514. When the compartment 5 is in a vertical dispensing position the piston 600 is below the selector 514.

The shaft of the cylinder of the pinion-enclosure 600 is mounted preferably substantially parallel to the direction of displacement of the slider 1514. The transverse ends 603 and 604 of the enclosure 600 are each fitted at their center with a pinion 605. The enclosure 600 is driven in rotation about its longitudinal axis via at least one gear rack 717 (FIG. 4*c*) that cooperates with the pinion 605 of the enclosure 600.

A substantially cylindrical channel 601 is provided in the enclosure 600. This channel is terminated by the lateral ends 603 and 604. A blind hole 602 is provided, approximately at the center of the channel 601, to cooperate, in snap-in manner, with a button 701 that is present on each gauge 700. The gauge has a shape that is complementary to that of the channel 601. The gauge 700 is inserted into the channel 601. Each gauge 700 is fitted with a cavity 703 at its upper part and is so mounted in the channel to receive a given type (size or shape) of tablets in its cavity 703. The selector slider 1514 can be adjusted as a function of the kind of gauge 700 mounted in the enclosure 600. In the case of a gauge 700 having a cavity 703 only on one side of its length, the slider 1514 is affixed in a position such that it will guide the tablet on the side of the gauge 700 that contains the cavity 703.

Figure 7:
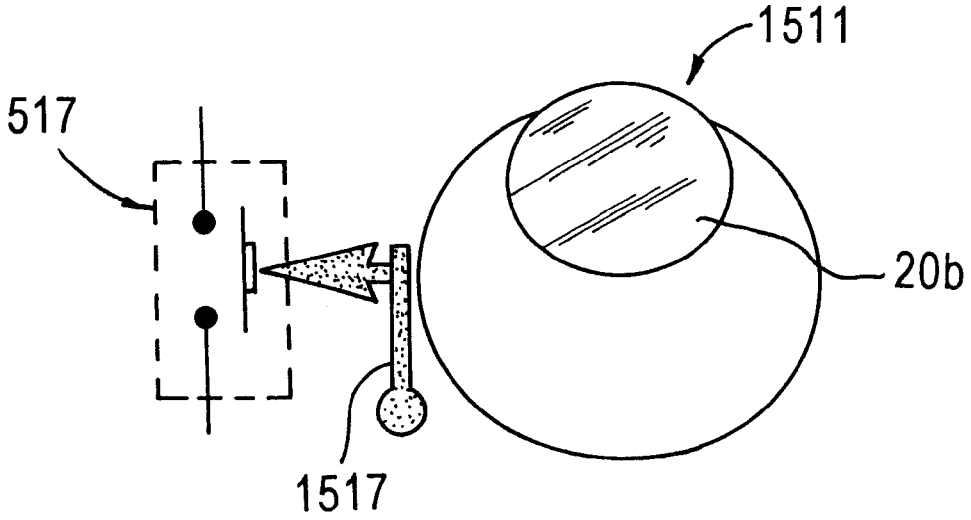
FIG. 7 is a functional diagram of atablet-transit detector.

Guided by the selector 514, the tablet enters the cavity 703 of the gauge 700 that has been snapped into place in the enclosure 600. The gauge 700 is matched to the tablet size and shape in such a manner that the tablet slightly protrudes our of the cylinder formed by the enclosure 600 (FIG. 7). The dispensing system 515 cooperates with the drive means 516 comprising an actuator drive button 516a suitably in the shape of a prism with triangular base The button 516*a* is located in the dispensing system 515.

When at rest, one of the sides of button 516*a* protrudes from the lateral front side 8 of the compartment 5. The drive button 516*a* is adapted to pivot about its sharpest crest 1516 which is substantially parallel to the direction of the axis of the cylindrical pinion-enclosure 600. When the button 516*a* pivots inward toward the compartment, it drives two gear racks 717 (FIG. 4*c*) each respectively housed in two wells 1517 (FIG. 4*b*) at the two ends of the seat for the button 516*a*. The two transitionally driven gear-racks cooperate with the pinions 605 of the enclosure 600 to drive latter into rotation.

The medication tablet, housed in the enclosure, slightly projects beyond this enclosure's periphery while at the same time rotating with this enclosure. In its transit, the tablet pushes a blade 1517 (FIGS. 4*c*, 7) to close an electric switch 517. Rotation of the medication continues until it is opposite the outlet orifice 14 (FIGS. 2*a*, 4*a*) of the lower end 11, then it drops, by gravity, out of the compartment 5 to be collected by the patient who had pressed the drive button 516*a*. A return spring 530, that may be in the shape of a dihedron, rests, on one of its two sides 531, against the inside surface of the button 516*a*. Its second surface 532 engages a stationary slot of the compartment 5 (FIG. 4*c*).

When the drive button is no longer actuated, the return spring 530 moves the button 516*a* back into its rest position by reversing the direction of motion of the gear-racks and hence also reversing the direction of the pinion enclosure 600. This double gear-rack system offers the advantage of minimizing the accidental locking of the dispensing system 515 and the drive means 516.

The compartment 5 is mechanically, and detachably, joined to the main module 2 by a locking means 501 and 502, that cooperate in a detachable manner with the fasteners 503 and 504. Each detachable compartment therefore comprises both a locking means 501 and 502 and fasteners 503 and 504. The first locking means 501 consist of a U-shaped strip 501. The feet 1501 of the U are affixed between the hood side or upper end 12 and the compartment 5 in a seat 12 and 122 (FIG. 3). The elliptical base 1511 of the U is thicker than its feet 1501 and snaps into an aperture 504 in the upper side 12 of the adjacent compartment 5 by entering through an opening 1504. The opening 1504 is disposed between the hood's upper end 12 and the body of the next adjacent compartment 5. The opening 1504 is substantially perpendicular to the aperture 504 in the hood 12 of the compartment 5. The shape of the aperture 504 is complementary to that of the elliptic base 1511 of the strip 501. This aperture 504 constitutes the fastener for the strip 501. The aperture 504 is present in the upper end 12 of the compartment 5 and it is substantially parallel to the common crest of respectively, the upper end 12 and the lateral contact side 10 fitted with the sealing hood 15. The opening 1504, which is perpendicular to the aperture 504, and through which the strip 501 enters, in turn is situated on the upper end of the lateral side 10 which is part of the sealing hood 15.

The lateral side 10 constitutes a common surface between two adjacent compartments 5. In this manner, when two compartments are joined, the hood 15 is neither visible nor accessible. This feature precludes accidentally opening the pillbox and hence opening the medication storage-space. Moreover, disassembly of the pillbox will be sensed by the fact that electric contacts become opened as a result of disassembly, for instance by opening a continuity loop.

A second locking means 502 is in the form of claws 502 located on the common crest of the lateral side 10 comprising the sealing hood 15 and the lower end 11 at the base of the compartment 5. The claws 502 hook into a locking means 503 consisting of complementary holes. These complementary holes 503 are situated at the base of the compartment 5 on the common crest of the lateral side 7 opposite and preferably parallel to the side 10 comprising the sealing hood 15, and the lower end 11. This crest is located opposite to the crest bearing the claws 502. The holes 503 are fitted with hookup rods placed in boreholes 13 (FIG. 4*c*). The hooks 502 rest on these rods.

Two compartments 5 are assembled by hooking the claws 502 of a first additional compartment 5 into the hookup rods in the holes 503 of a preceding additional compartment, then pivoting the first additional compartment 5 until the strip 501 of the preceding compartment snaps into the aperture 504 of this first additional compartment 5. In this manner the lateral side 10 comprising the sealing hood 15 of the first additional compartment is moved against the lateral side 7 of the preceding compartment.

Each compartment 5 also comprises at its inside the electronics 505 located within the hood 511 (FIG. 3) and male and female connectors 520 and 521 respectively. These two connectors are respectively present on two opposite lateral contacting sides 7 and 10, respectively, that comprise the strip 501 and the sealing hood 15.

During assembly, electrical connection of the electronics 505 is implemented as follows: the male connector 520 of the preceding compartment is connected to the female connector 521 of the first additional compartment. The first additional compartment 5 also comprises an access hatch 800 for accessing the enclosure 600 that has been closed by an enclosure-sealing cap 801. This is illustrated to be affixed by means of four studs 803. The hatch 800 allows changing the size of the gauge 700 to match the size of the tablets introduced into the storage space 512 of the compartment 5.

A nomogram may be made to define the kinds of gauges 700 and adjustments of the selectors 514 used for the different medications. Detectors 517 sensing the transit of the tablet (FIG. 7), and suitably comprising a microswitch, are positioned near the peripheral surface of the enclosure 600 of the cylindrical well 115 on the side of the lateral back side 9 of the compartment 5. These detectors are actuated by the projection 1511 of the tablet 20*b* beyond the enclosure during its rotation. This projection pushes a blade 1517 (FIG. 4*c*) which makes contact in an electric circuit.

Figure 8:
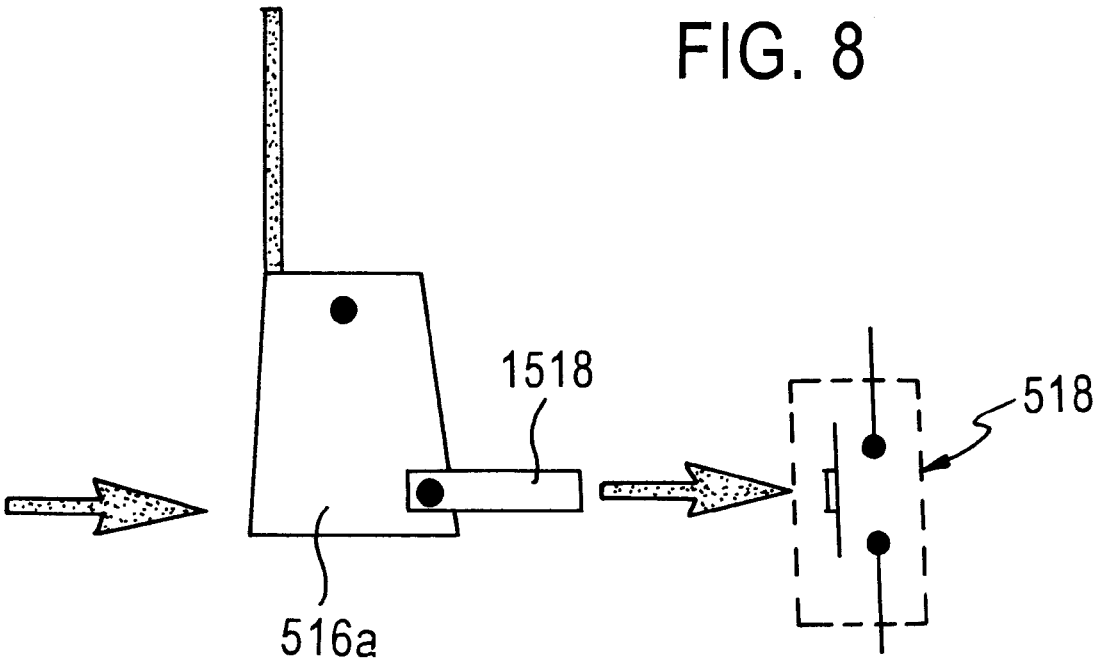
FIG. 8 is a functional diagram of a sensor means for detecting pressure on the tablet-issuance means.

The compartment 5 also comprises detectors 518 that are adapted to sense the pressure on the drive means (FIG. 8). These sensors comprise a microswitch driven by a stud 1518 affixed to the button 516*a*. In this manner the electronics 505 is able to record on one hand the pressure on the drive means 516 and on the other the transit of a tablet through the dispensing system 515. Moreover the compartment 5 comprises means 513 for keeping the medications biased in the direction of the base of the storage space 512. This means 513 may consist of a pallet, for instance a rectangular plate affixed to a slider (not shown) that is adapted to slide in a vertical channel 1513 situated substantially at the middle of the lateral back side 9 of the compartment 5. Biasing means (not shown), such as an elastic member, push said plate toward the ejecting and dispensing means 514 and 515 respectively at the base of the storage space 512 of the compartment 5.

In this manner the pallet 513 presses down on the pile of medications contained in the storage space 512 and facilitates their intake into the dispensing systems 515 at the lower end of this storage space. It is moreover possible to monitor the level of the medications present in the compartment by observing the slider position in its channel 1513.

The two-compartment main module 2 as well as each additional compartment 5 comprises a slot 540 in the contacting lateral side 10 joined to the hood 15. The slot 540 is located near, and parallel to, the lateral back sides 9. The slot 540 may receive a data medium 4 (FIG. 1) such as a chip card, for instance the size of a standard credit card. The card is inserted about two-thirds of the way into the main module 2 (FIG. 1) and thereupon its projecting portion is inserted into the slot 540 of the lateral side 10 comprising the hood 15 of the first additional compartment 5 which joins the main module 2. Thereupon the data medium 4 will be completely enclosed in the medication dispenser 1, straddling the three first compartments 2*a*, 2*b*, 5. The data medium 4 thus is able to cooperate henceforth with the electronics 505 in the compartment 5 (FIG. 3) as well as with the electronics (not shown) of the main module 2.

Each compartment 5 also comprises alarms 6, for instance in the form of an LED 1006 connected to the electronics 505. The diode (LED) is mounted in a diode-supporting tube 1016 issuing from the lateral front side 8 parallel to the lateral back side 9 of the compartment 5. The diode 1006, when controlled by the electronics of the main module, is adapted to emit an illustratively blinking light signal to advise the patient which compartment 5 to use to withdraw the proper medication. The alarms can also be in the form of known acoustic means (not shown). Combinations of visual and auditory alarms are considered to be within the scope of this invention. Illustratively such an acoustic alarm may be triggered by the electronics 505 to notify the patient to take medication. Thereupon the particular compartment is flagged by the light signal from the diode 1006 in the manner already described above.

Besides the alarms 6, the main module 2 (FIG. 1) in turn comprises visual displays 3, for instance in the form of a liquid crystal screen. These visual displays 3 of additional data are present on the upper side 12.

Other modifications within the knowledge of the person of ordinary skill in this art also are within the scope of the present invention.

what is claimed is:

1. A modular medication dispenser comprising:

A. a main module comprising:

(i). at least one compartment; and (ii). electronics for memory, calculation and data retrieval relating to dispensing medication from each compartment, (iii). a visual data display, and (iv). at least one alarm; and B. at least one detachable, additional compartment comprising:

locking means and fasteners adapted to attach a each additional compartment to a preceding and succeeding compartment and to said main module;

wherein each compartment comprises a storage space for one type of tablets; and wherein each compartment contains a drive means for a unit-dispensing a tablet of different size or shape.

2. A medication dispenser as claimed in claim 1, wherein a first additional compartment is attached to the main module, and succeeding compartments are attached to each other laterally, and wherein the $(n+1)^{th}$ additional compartment is detachable attached to the $n^{th}$ additional compartment.

3. A medication dispenser as claimed in claim 1, wherein each successive compartment comprises electronics that are connected to the electronics of the preceding compartment.

4. A medication dispenser as claimed in claim 1, wherein each detachable compartment comprises a case that is open at two adjacent sides, a complementary hood and a detachable sealing cover that cooperates with the case to enclose the compartment);

wherein each compartment comprises:

a storage space for a plurality of solid form medication;

means for biasing the plurality of solid form medications toward one end of the storage space, that is defined as the base of the storage space;

a substantially cylindrical well in effective contact with an outlet orifice in a lower surface of the compartment;

a substantially cylindrical pinion-enclosure in said well; and means for rotationally driving said cylindrical pinion enclosure about its axis in the well.

5. A medication dispenser as claimed in claim 4 further comprising an adaptable dispensing components that comprises a channel in the cylindrical enclosure, wherein said channel is fitted with means for housing at least one detachable gauges having shape(s) complementing the channel shape; wherein said gauge contains at least one cavity and each cavity is sized and shaped to accept a predetermined size and shape of solid medication in such a position that a portion thereof slightly projects out of the cylinder subtended by the enclosure.

6. A medication dispenser as claimed in claim 4, further comprising;

a drive button disposed in a housing in a lateral side of said compartment;

wherein said drive button is displaceable toward the inside of the compartment and by said displacement is adapted to drive, in translation, at least one gear rack guided within a well at an end of said housing, wherein each gear rack cooperates with pinion means mounted at ends of the enclosure, wherein said gear rack is adapted to rotate said pinion, and a return spring adapted to cause said button to return to its rest position when said inward displacement is released.

7. A medication dispenser as claimed in claim 6, wherein at least one compartment contains selection means disposed proximate to a base of the storage space and upstream of said well.

8. A medication dispenser as claimed in claim 7, further comprising:

a selection means comprising a selector having two surfaces that slope toward each other in the direction of the base of said container in a truncated V-form; and a selector slider that is displaceable between two strips;

wherein said selection means is adapted to guide tablets toward a channel at about the center of the selector; and wherein the slider is adapted to guide the tablet toward a passage in said selector having a size and shape matching that of the tablet.

9. A medication dispenser as claimed in claim 8, further comprising at least one gauge and means to adjust the sliders of the selectors from a nomogram defining the types of gauges and the positions of the selectors to be used for different types of medications.

10. A medication dispenser (1) as claimed in claim 9, wherein said detachable locking means comprises a substantially U-shaped strip, wherein the feet of the U are affixed to an upper end of a lateral side of a compartment that contacts a surface of an adjacent compartment, wherein the base of the U is thicker than its feet, and wherein at least one claw is located proximate to a crest that is common to a lower surface and to a lateral contacting side of said container that is opposite and parallel to the surface bearing the strip, and wherein complementary fasteners comprise holes fitted with hookup rods, wherein said holes are located on the common crest of the lower surface and of the lateral contacting side bearing the strip on a crest opposite to the crest bearing the claws, and of an aperture in an upper surface of the compartment near the crest with the lateral contacting side bearing the claws, wherein the claws of the additional compartment hook up with the hookup rods in the holes of the preceding compartment, and wherein a base of the strip of the preceding compartment is elliptical and is snapped into the aperture of the additional compartment while entering through an opening that is substantially perpendicular to the aperture and is located at an upper end of the lateral side bearing the claws.

11. A medication dispenser as claimed in claim 4 wherein the means pressing the tablets toward the base of the storage space comprises:

a biasing pallet affixed to a slider moving in a vertical channel located in a back lateral side of the compartment, and elastic means biasing the pallet toward the dispensing components located proximate to a base of the storage space of the compartment.

12. A medication dispenser as claimed in claim 1 further comprising at least one tablet transit sensing detector in at least one of said compartments.

13. A medication dispenser as claimed in claim 5, wherein each compartment comprises at least one tablet-transit detector comprising a mechanical microswitch located proximate to a peripheral surface of the cylindrical enclosure; wherein said microswitch is activated by contact with the projection of the tablet outside the enclosure during its rotation.

14. A medication dispenser as claimed in claim 1, further comprising a detector adapted to sense pressure on drive means in at least one of said compartments.

15. A medication dispenser as claimed in claim 14, wherein said detector adapted to sense pressure on the drive means comprises at least one microswitch actuated by a stud that is substantially rigidly joined to the button.

16. A medication dispenser as claimed in claim 1, wherein the main module comprises two compartments, the additional compartment attached to the main module comprises a slot located in a lateral contact side between two adjacent compartments, the slot is adapted to accept a data medium by insertion thereof in a position straddling the main module and the first additional compartment.

17. A medication dispenser as claimed in any of claim 16, wherein the visual means comprises a liquid crystal display screen.

18. A medication dispenser as claimed in claim 1, wherein the alarm comprises at least one of an LED and an acoustic means.

19. A medication dispenser as claimed in claim 4, wherein at least one compartment comprises an access hatch to the enclosure adapted to permit the installation of at least one gauges and wherein said hatch is adapted to be closed by an enclosure-mask affixed by studs.

* * * * *